US005930573A

United States Patent [19]

Miyamoto et al.

[11] Patent Number: 5,930,573

[45] Date of Patent: Jul. 27, 1999

[54] IMAGE FORMING APPARATUS AND IMAGE TRANSFERRING DEVICE THEREOF HAVING CONVEYING MEMBER WITH SELECTED SURFACE RESISTIVITY

[75] Inventors: Kazue Miyamoto; Hirokazu Ishii, both of Tokyo, Japan

[73] Assignee: Ricoh Company, Ltd., Tokyo, Japan

[21] Appl. No.: 09/070,605

[22] Filed: May 1, 1998

[30] Foreign Application Priority Data

Oct. 6, 1997 [JP] Japan ..... 9-271820

[51] Int. Cl.[6] ..... G03G 15/16

[52] U.S. Cl. ..... 399/310; 399/312

[58] Field of Search ..... 399/299, 300, 399/302, 303, 308, 312, 313, 310

[56] References Cited

U.S. PATENT DOCUMENTS 4,369,729 1/1983 Shigenobu et al. ..... 118/60
5,321,477 6/1994 Nagata et al. ..... 399/312
5,461,461 10/1995 Harasawa et al. .
5,495,317 2/1996 Matsuda et al. .
5,515,146 5/1996 Harasawa et al. .
5,557,384 9/1996 Takano et al. .
5,640,660 6/1997 Takano et al. .
5,659,843 8/1997 Takano et al. .
5,666,622 9/1997 Harasawa et al. .
5,832,351 11/1998 Takekoshi et al. ..... 399/303

*Primary Examiner*—Joan Pendegrass
*Attorney, Agent, or Firm*—Oblon, Spivak, McClelland, Maier & Neustadt, P.C.

[57] ABSTRACT

A conveying member for conveying a recording medium carrying a toner image transferred thereto from an image carrier, an image transferring device including the conveying member, and an image forming apparatus including the image transferring device are disclosed. The conveying member has its surface resistivity so regulated as to prevent toner from being scattered on a recording medium. Also, the range of the surface resistivity or the relation between the surface resistivities of front and rear layers constituting the conveying members is so selected as to insure the conveyance of the recording medium and obviate defective images ascribable to defective image transfer.

19 Claims, 7 Drawing Sheets

Fig. 7

| SURFACE RESISTIVITY OF REAR (Ω) | TRANSFER CURRENT (-μA) | | | | | | DECISION |
|---|---|---|---|---|---|---|---|
| | 30 | 40 | 50 | 60 | 70 | 80 | |
| $5.5 \times 10^{8}$ | ○ | ○ | × | × | × | × | × |
| $4.0 \times 10^{9}$ | ○ | ○ | ○ | △ | × | × | ○ |
| $2.0 \times 10^{11}$ | ○ | ○ | ○ | ○ | ○ | △ | ○ |
| $2.5 \times 10^{12}$ | ○ | ○ | ○ | ○ | ○ | ○ | ○ |
| $5.0 \times 10^{14}$ | × | × | × | × | × | × | × |
| $7.3 \times 10^{13}$ | ○ | ○ | ○ | ○ | ○ | ○ | ○ |

Fig. 8

| SAMPLE (BELT) | SURFACE RESISTIVITY (Ω) ※ HIGH TEMPERATURE & HIGH HUMIDITY (30°C & 90%) | | DECISION |
|---|---|---|---|
| | FRONT | REAR | |
| A | $6.0 \times 10^{9}$ | $1.4 \times 10^{10}$ | ○ |
| B | $3.7 \times 10^{9}$ | $4.0 \times 10^{9}$ | ○ |
| C | $1.9 \times 10^{10}$ | $1.3 \times 10^{12}$ | ○ |
| D | $3.0 \times 10^{8}$ | $4.6 \times 10^{10}$ | ○ |
| E | $2.5 \times 10^{9}$ | $6.8 \times 10^{8}$ | × |
| F | $1.8 \times 10^{10}$ | $2.5 \times 10^{8}$ | × |
| G | $4.6 \times 10^{10}$ | $5.8 \times 10^{8}$ | × |
| H | $4.6 \times 10^{10}$ | $8.9 \times 10^{7}$ | × |
| I | $3.7 \times 10^{7}$ | $3.3 \times 10^{8}$ | × |
| J | $6.2 \times 10^{7}$ | $6.3 \times 10^{10}$ | × |
| K | $6.2 \times 10^{7}$ | $7.4 \times 10^{13}$ | × |

Fig. 9

| SAMPLE (BELT) | SURFACE RESISTIVITY ※ HIGH TEMPERATURE & HIGH HUMIDITY (30°C & 90%) | | DECISION ON SEPARATION & CONVEYANCE | SURFACE RESISTIVITY ※ LOW TEMPERATURE & LOW HUMIDITY (10°C & 15%) | | DECISION ON TONER SCATTERING |
|---|---|---|---|---|---|---|
| | FRONT | REAR | | FRONT | REAR | |
| A | $6.0 \times 10^{9}$ | $1.4 \times 10^{10}$ | O | $3.5 \times 10^{12}$ | $2.8 \times 10^{9}$ | O |
| B | $3.7 \times 10^{9}$ | $4.0 \times 10^{9}$ | O | $2.4 \times 10^{11}$ | $3.3 \times 10^{9}$ | O |
| C | $1.9 \times 10^{10}$ | $1.3 \times 10^{12}$ | O | $9.7 \times 10^{11}$ | $2.1 \times 10^{9}$ | O |
| D | $3.0 \times 10^{8}$ | $4.6 \times 10^{10}$ | O | $8.7 \times 10^{11}$ | $2.8 \times 10^{8}$ | X |
| E | $2.5 \times 10^{9}$ | $6.8 \times 10^{8}$ | X | $1.1 \times 10^{13}$ | $1.7 \times 10^{9}$ | O |
| F | $1.8 \times 10^{10}$ | $2.5 \times 10^{8}$ | X | $4.3 \times 10^{13}$ | $6.0 \times 10^{10}$ | O |
| G | $4.6 \times 10^{10}$ | $5.8 \times 10^{8}$ | X | $3.8 \times 10^{11}$ | $7.0 \times 10^{8}$ | X |
| H | $4.6 \times 10^{10}$ | $8.9 \times 10^{7}$ | X | $3.6 \times 10^{13}$ | $6.3 \times 10^{8}$ | X |
| I | $3.7 \times 10^{7}$ | $3.3 \times 10^{8}$ | X | $9.0 \times 10^{12}$ | $2.9 \times 10^{9}$ | O |
| J | $6.2 \times 10^{7}$ | $6.3 \times 10^{10}$ | X | $2.1 \times 10^{13}$ | $1.5 \times 10^{10}$ | O |
| K | $6.2 \times 10^{7}$ | $7.4 \times 10^{13}$ | X | $6.2 \times 10^{12}$ | $6.0 \times 10^{9}$ | O |

IMAGE FORMING APPARATUS AND IMAGE TRANSFERRING DEVICE THEREOF HAVING CONVEYING MEMBER WITH SELECTED SURFACE RESISTIVITY

BACKGROUND OF THE INVENTION

The present invention relates to a conveying member for conveying a recording medium carrying a toner image transferred thereto from an image carrier, an image transferring device including the conveying member, and an image forming apparatus including the image transferring device.

An image forming apparatus of the type including a photoconductive element, intermediate image transfer belt or similar image carrier and a transfer belt, transfer drum or similar conveying member is conventional. A toner image formed on the photoconductive element is transferred to a sheet or similar recording medium by the conveying member to which a bias for image transfer is applied. In this type of apparatus, image transfer is effected by the electric resistance of the conveying member, e.g., transfer belt. Various approaches have heretofore been proposed to provide the transfer belt with an adequate resistance.

Japanese Patent Laid-Open Publication No. 63-83762, for example, teaches a transfer belt including a portion formed of a semiconductor material and having a volume resistivity of $10^{10}$ Ωcm to $10^{13}$ Ωcm. The transfer belt is passed over a drive roller and a ground roller spaced from each other by a preselected distance. A wrap roller supports the rear or inner surface of the belt in the vicinity of a photoconductive element. In this configuration, the portion of the belt between the ground roller or charge reduction source and the wrap roller plays the role of a stable resistor, so that charge fed from a transfer charger can be held in a stable condition. A technology relating to the electric resistance of the transfer belt is also disclosed in Japanese Patent Laid-Open Publication No. 1-121877.

Japanese Patent Laid-Open Publication No. 2-110586 discloses a transfer belt made up of a resistance layer having a resistance higher than $10^{14}$ Ωcm and close to a photoconductive element, and a resistance layer having a resistance lower than $10^{14}$ Ωcm and remote from the photoconductive element. With this structure, the transfer belt has its surface potential regulated to a desired gradient. This kind of structure is directed toward the obviation of the flying of toner and the local omission of an image.

Assume that a bias for image transfer is applied from the rear or inner surface of the transfer belt remote from the photoconductive element. Then, if the surface resistivity of the rear of the belt is low, a transfer current easily flows from a position where the bias is applied to the other region, as well known in the art. Usually, the transfer current flows to a nip between the photoconductive element and the belt and where image transfer is expected to occur. However, when the surface resistivity of the rear is low, the transfer current flows to a position upstream of the above nip, i.e., where the photoconductive element and belt do not contact each other. As a result, transfer charge flows out to the position upstream of the nip, forming an electric field. This electric field causes a toner image to be partly transferred from the photoconductive element to a sheet being conveyed by the belt. Such an occurrence is generally referred to as pretransfer. Because the pretransfer occurs at the position upstream of the nip or regular image transfer position, the above part of the toner image is transferred to the position of the sheet deviated from the expected position. Let this undesirable occurrence be referred to as toner scattering hereinafter.

The toner scattering is aggravated in a low humidity environment of the following reason. The surface resistivity of the transfer belt is higher when humidity is low than when it is normal. As a result, in a low humidity environment, the voltage on the surface of the belt increases in the region preceding the nip, causing discharge to occur between the photoconductive element and the belt.

Furthermore, if the surface resistivity of the front of the transfer belt facing the photoconductive element is excessively high, then the charge derived from the bias applied to the belt remains even after image transfer. Consequently, when image formation is repeated, images formed on the second sheet and successive sheets or on both sides of sheets are apt to be defective.

On the other hand, the surface resistivity of the transfer belt has influence on the conveyance of the sheet by the belt, and the separation of the sheet from the photoconductive element which is effected by the conveyance. Specifically, when the surface resistivity of the belt is low, charge great enough for the sheet to electrostatically adhere to the belt stably is not accumulated. In this condition, it is likely that the sheet slips on the belt and brings about the dislocation of the toner image or that the sheet moved away from the nip wraps around the photoconductive element without being separated from the element. Moreover, in a high humidity environment, the surface resistivity of the belt is higher than in a normal humidity environment and causes the charge on the belt to reduce. This reduces the electrostatic adhesion of the sheet to the belt and thereby aggravates the defective separation of the sheet from the photoconductive element.

Although various schemes relating to the resistance of the transfer belt have been proposed in the past, as stated earlier, all of them regulate the resistance of the belt in the macroscale in terms of, e.g., volume resistivity. Stated another way, none of the conventional schemes clear up the mechanism relating to the image transfer and the conveyance of the sheet, i.e., the separation of the sheet from the photoconductive element.

SUMMARY OF THE INVENTION

It is therefore an object of the present invention to provide an image transferring device capable of obviating toner scattering by regulating the surface potential of a transfer belt, and insuring the conveyance of a sheet by confining the surface resistance in a particular range or providing the surface resistivities of front and rear layers of the belt with a particular relation, and obviating defective images ascribable to defective image transfer, and an image forming apparatus including the same.

In accordance with the present invention ,in a conveying member for conveying a recording medium carrying a toner image transferred from an image carrier, the rear of the conveying member remote from the image carrier has a surface resistivity higher than the surface resistivity of the front close to the image carrier.

Also, in accordance with the present invention, in a conveying member for conveying a recording medium carrying a toner image transferred from an image carrier, the rear of the conveying member remote from the image carrier has a surface resistivity equal to or higher than the surface resistivity of the front close to the image carrier when measured in an environment of high temperature of 30° C. and high humidity of 90%, but lower than the surface resistivity of the front when measured in an environment of low temperature of 10° C. and low humidity of 15%.

Further, in accordance with the present invention, an image forming apparatus includes an image carrier for forming a toner image thereon, a conveying member for conveying a recording medium to which the toner image is transferred from the image carrier, and a transfer electrode for applying an image transfer bias to the conveying member. The conveying member has a rear remote from the image carrier and having a surface resistivity higher than the surface resistivity of the front close to said image carrier.

BRIEF DESCRIPTION OF THE DRAWINGS

The above and other objects, features and advantage of the present invention will become apparent from the following detailed description taken with the accompanying drawings in which:

FIG. 7 is a table listing the results of experiments relating to a relation between the surface resistivity of the transfer belt and the toner scattering;

FIG. 8 is a table listing the results of experiments relating to a relation between the surface resistivity of the transfer belt and the separation and conveyance of a sheet; and FIG. 9 is a table listing the results of experiments relating to a relation between the toner scattering and separation and conveyance of a sheet and the surface resistivity of the transfer belt.

DESCRIPTION OF THE PREFERRED EMBODIMENT

Figure 1:
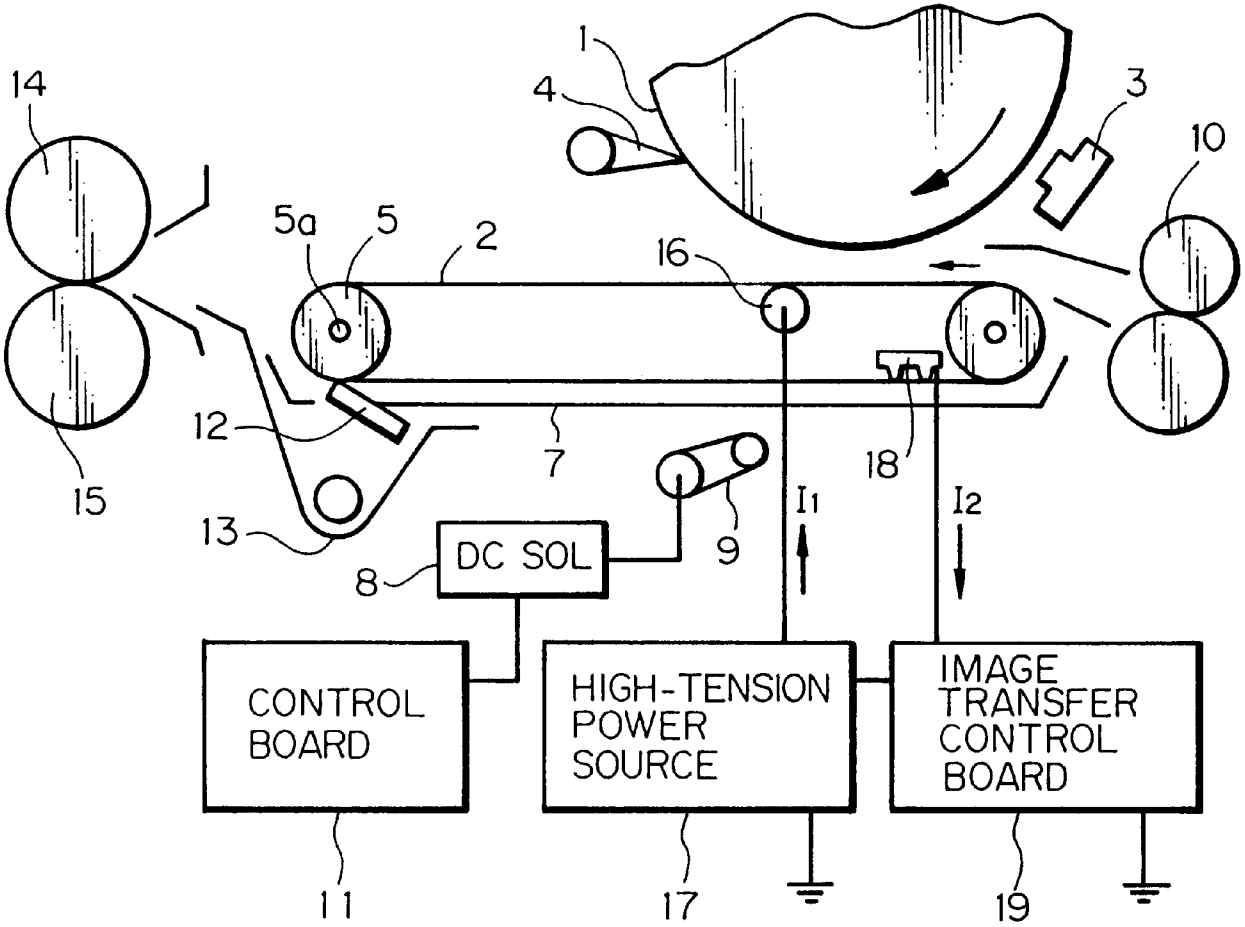
FIG. 1 is a front view showing an image transferring device embodying the present invention in a condition before image transfer.
Figure 2:
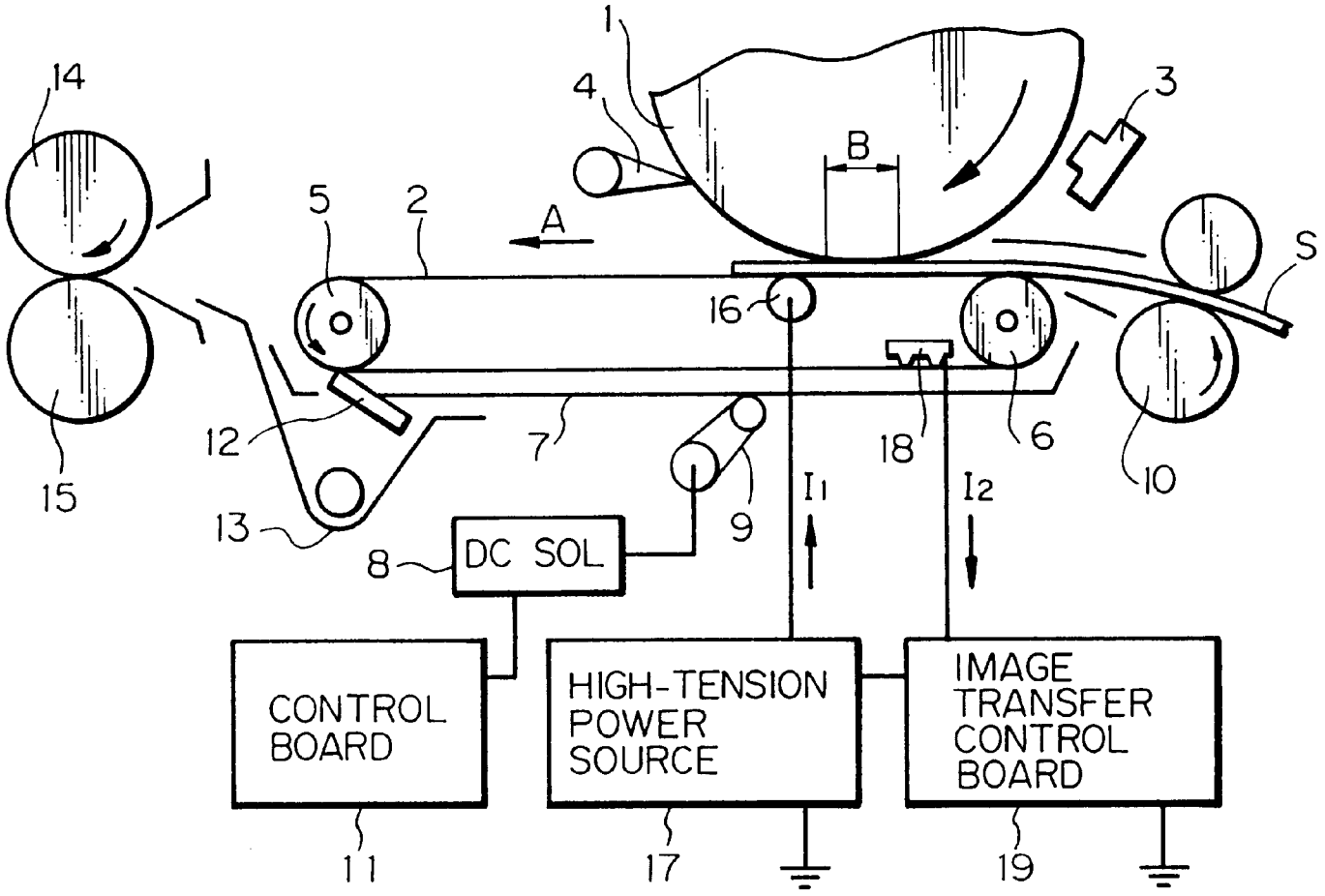
FIG. 2 is a front view showing the illustrative embodiment in a condition during image transfer.
Figure 3:
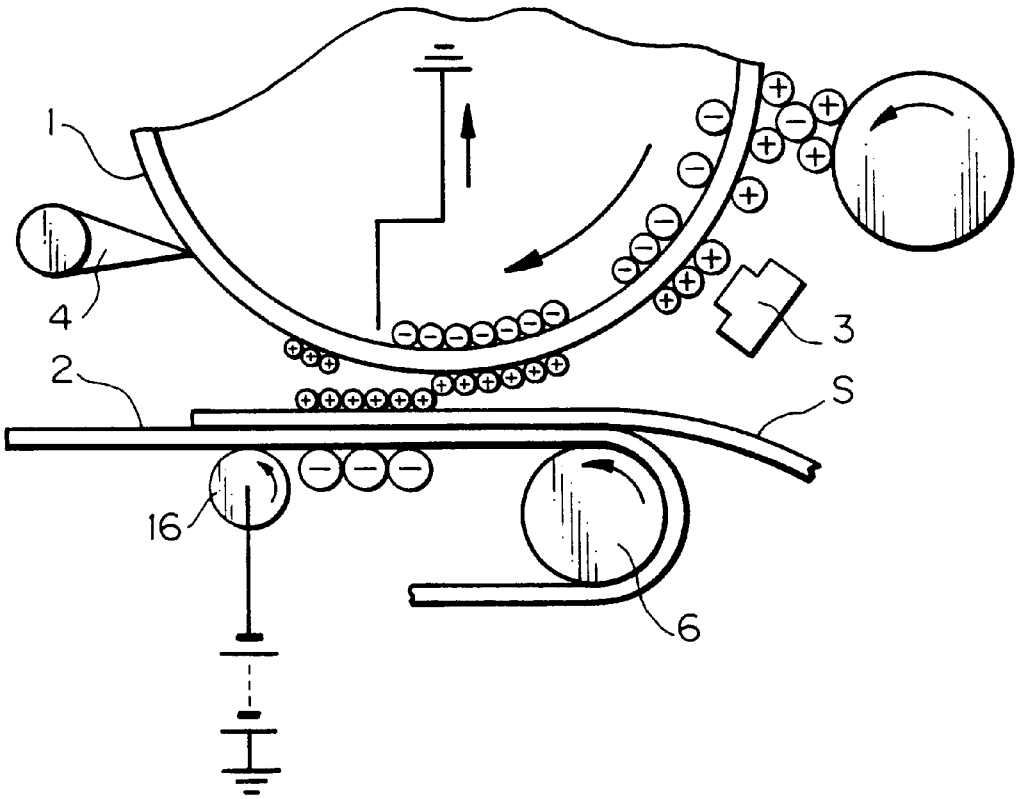
FIG. 3 is a fragmentary enlarged view showing the condition of FIG. 2.

A preferred embodiment of the image forming apparatus and image transferring device in accordance with the present invention will be described hereinafter. First, the basic configuration of an image transferring device for an electrophotographic image forming apparatus will be described. Referring to FIGS. 1–3, the image forming apparatus includes a photoconductive element in the form of a drum 1. Arranged around the drum 1 are various process units including a charger, an optical writing unit, a developing unit, and a cleaning unit, although not shown specifically. The charger uniformly charges the surface of the drum 1. The optical writing unit scans the charged surface of the drum 1 with a laser beam modulated in accordance with an image signal, thereby forming a latent image electrostatically on the drum 1. The developing unit develops the latent image and thereby forms a corresponding toner image. The cleaning unit cleans the surface of the drum 1 after image transfer.

A pretransfer discharge lamp 3 and a peeler 4 are also arranged around the drum 1. The pretransfer discharge lamp 3 adjoins a transfer belt 2 and lowers charge deposited on the drum 1. The peeler 4 separates, or peels off, a sheet or recording medium S from the drum 1. The transfer belt 2 is passed over a pair of rollers 5 and 6 supported by a roller support 7. The roller support 7 is angularly movable toward and away from the drum 1 about the shaft 5*a* of the roller 5. An arm 9 is positioned below the roller support 7 and angularly movable by being driven by a DC solenoid 8. When the leading edge of the sheet S being conveyed by a registration roller 10 approaches the drum 1, a control board 11 drives the DC solenoid 8. In response, the DC solenoid 8 causes the arm 9 to push the roller support 7 upward. As a result, as shown in FIG. 2, the transfer belt 2 presses the sheet S against the drum 1. In this condition, a motor, not shown, drives the roller 5 with the result that the transfer belt 2 is caused to turn counterclockwise, as indicated by an arrow A in FIG. 1.

A belt cleaning unit 13 is positioned in the vicinity of the downstream end of the transfer belt 2 in the direction of rotation of the belt 2. The belt cleaning unit 13 includes a cleaning blade 12 contacting the portion of the transfer belt 2 passed over the roller 5. A heat roller 14 and a press roller 15 pressed against each other are positioned downstream of the cleaning unit 13 in the above direction in order to fix the toner image on the sheet S.

A contact type transfer member in the form of a transfer roller 16 is held in contact with the rear or inner surface of the transfer belt 2 in order to apply a bias for image transfer to the belt 2. As shown in FIG. 2, the transfer roller 16 is connected to a high-tension power source 17 and located downstream of a nip B between the drum 1 and the transfer belt 2. A contact plate 28 is also held in contact with the rear of the transfer belt 2. An image transfer control board 19 for controlling the power source 17 is connected to the contact plate 18. The contact plate 18 detects a current flowing through the transfer belt 2 and feeds it back to the transfer control board 19.

The surface of the drum 1 is charged to, e.g., −800 V. As shown in FIG. 3, the charged surface of the drum 1 moves to the nip B while carrying toner charged to the positive polarity electrostatically thereon. At this instant, the pretransfer discharge lamp 3 lowers the charge of the toner 1. In FIG. 3, the toner with the lowered charge is indicated by smaller circles than the toner with the original positive charge.

At the nip B shown in FIG. 2, the toner is transferred from the drum 1 to the sheet S by the transfer bias applied via the transfer roller 16. The transfer bias output from the power source 17 is, e.g., between −1.5 kV and −6.5 kV. Assume that the current output from the power source 17 is $I_1$, and that the current flowing from the contact plate 18 to ground via the transfer belt 2 is $I_2$. Then, the image transfer control board 19 controls the output of the power source 17 such that the following equation holds:

$$I_1 - I_2 = I_{out}$$

where $I_{out}$ is constant.

When the above relation is satisfied, the surface charge on the sheet S is stabilized without regard to temperature, humidity and other environmental conditions or the scatter of the transfer belt 2 ascribable to a production line. This successfully prevents the image transfer efficiency from varying. More specifically, considering that a current to flow to the drum 1 via the transfer belt 2 and sheet S is $I_{out}$, it is possible to free the sheet separation and image transfer from the influence of the degree of easy flow of the current to the transfer belt 2 which varies due to a decrease or an increase in the surface resistance of the sheet S.

When the toner image is transferred from the drum 1 to the sheet S, the sheet is also charged. As a result, the sheet S is caused to electrostatically adhere to the transfer belt 2 and separated from the drum 1 due to a relation between the true charge of the belt 2 and the polarized charge of the sheet S. Such separation of the sheet S from the drum 1 is further promoted by the elasticity of the sheet S itself implemented by the curvature of the drum 1.

Figure 4:
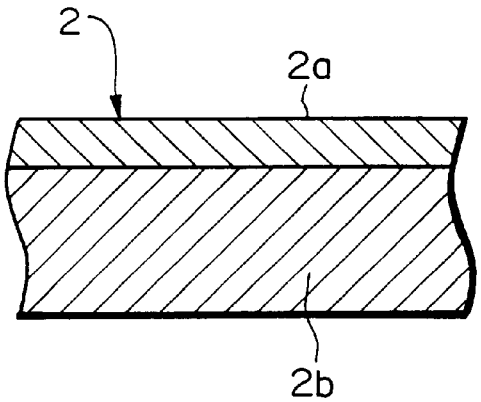
FIG. 4 is a section showing a transfer belt included in the illustrative embodiment.

As shown in FIG. 4, the transfer belt 2 has a double layer structure, i.e., a front or outer layer 2*a* capable of contacting the drum 1 and a rear or inner layer 2*b* underlying the front layer 2*a*. The rear layer 2*b* is formed of chloroprene rubber, EPDM rubber (ethylene-propylene copolymer), silicone rubber, epichloro rubber or similar sparingly hygroscopic substance and carbon, zinc oxide or similar resistance control agent added thereto in an adequate amount for implementing a preselected surface resistivity. The front layer 2*a* consists of fluorocarbon resin or similar lubricant solid serving as a major agent, polyurethane (thermosetting) or similar binder added to the major agent, and a curing agent, lubricant, leveling agent and reinforcing agent mixed with the mixture of the major agent and binder. The resulting mixture is diluted with a diluent.

A relation between the surface resistivity of the transfer belt and the toner scattering was determined by experiments based on JIS (Japanese Industrial Standards) K6911. Specifically, there were prepared six different samples having rear layers 2*b* whose surface resistivities were respectively measured to be $5.5\times10^{8}$ Ω, $4.0\times10^{9}$ Ω, $2.0\times10^{11}$ Ω, $2.5\times10^{12}$ 106 , $3\times10^{13}$ Ω and $5.0\times10^{14}$ Ω when a DC 100 V was applied. The transfer current fed from the high-tension power source 17 to the transfer roller 16 was varied in six consecutive steps for each of the samples. The experiments were conducted in a low temperature, low humidity environment more likely to bring about toner scattering (temperature of 10° C. and humidity of 15%). The results of such experiments are listed in FIG. 7 in which circles, triangles and crosses indicate "good", "acceptable" and "no good", respectively.

As FIG. 7 indicates, when the surface resistivity of the rear layer 2*b* is of the order of $10^{8}$ Ω, a desirable result is not achievable except for an extremely limited range of transfer currents. By contrast, when the surface resistivity is of the order of $10^{9}$ Ω or above, images with a minimum of toner scattering are achievable even over a relatively broad range of transfer currents except for a certain narrow range. However, surface resistivities of the order of $10^{14}$ Ω and above result in defective images. More specifically, the experiments and studies based thereon showed the following. When the surface resistivity of the rear layer 2*b* was provided with a lower limit of $1\times10^{9}$ Ω, the application of the transfer bias from the rear of the transfer belt 2 limited the potential of the belt 2 at the nip assigned to image transfer. As a result, discharge between the drum 1 and the transfer roller 16 was restricted, so that the toner scattering was obviated. It was also found that surface resistivities less than $1\times10^{14}$ Ω eliminated defective images.

Figure 5:
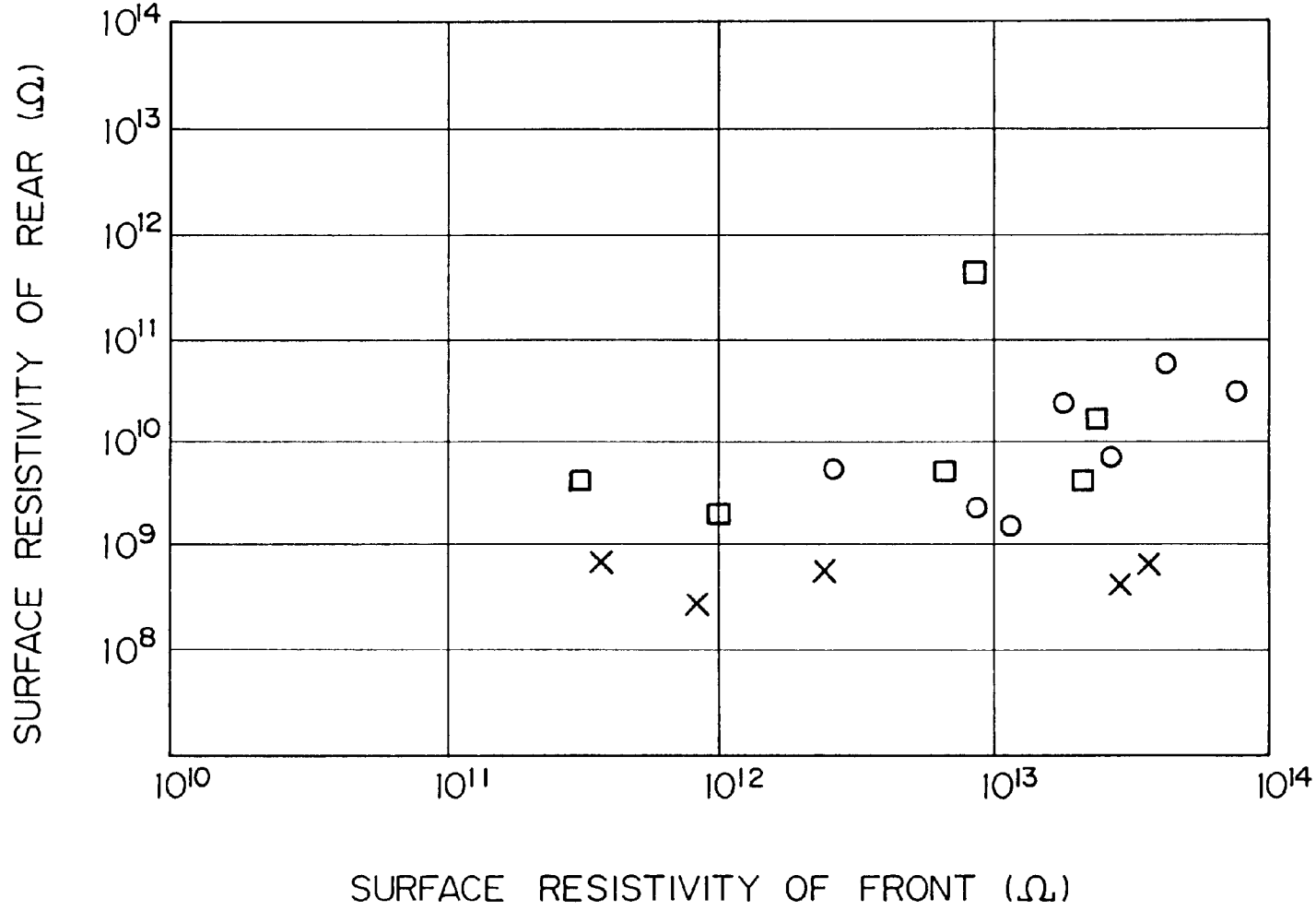
FIG. 5 is a graph plotting the results of experiments relating to toner scattering.

FIG. 5 shows the surface resistivity of the rear layer 2*b* and the surface resistivity of the front layer 2*a* on the ordinate and abscissa, respectively. FIG. 5 demonstrates how the combination of the surface resistivity of the front layer 2 and that of the rear layer 2*b* effects the toner scattering, as also determined by experiments. For the experiments, use was made of samples each having a particular combination of the above two surface resistivities. In FIG. 5, circles and squares indicate "good" while crosses indicate "no good"; circles and squares are identical as to surface resistivity and different only in the other factors including material.

As shown in FIG. 5, the surface resistivity of the rear layer 2 and that of the front layer 2*a* are limited to higher than $10^{9}$ Ω inclusive and lower than $10^{14}$ Ω, respectively. By limiting the upper limit of the surface resistivity of the front layer 2*a,* it was possible to obviate discharge between the drum 1 and the sheet S and therefore to produce images free from toner scattering.

A series of experiments were conducted in accordance with JIS K6911 in order to determine a relation between the surface resistivities of the transfer belt 2 and the separation and conveyance of the sheet S. The separation and conveyance of the sheet S was evaluated in terms of the separation of the sheet S from the drum 1 and adhesion of the sheet S to the transfer belt 2. Eleven samples different from each other in the surface resistance of the front layer 2*a* and that of the rear layer 2*b* when applied with a DC 100 V were prepared. The experiments were conducted in a high temperature, high humidity environment (temperature of 20° C. and humidity of 90%) more likely to deteriorate the separation and conveyance. The results of such experiments are shown in FIGS. 6 and 8 in which circles and crosses indicate "good" and "no good", respectively.

Figure 6:
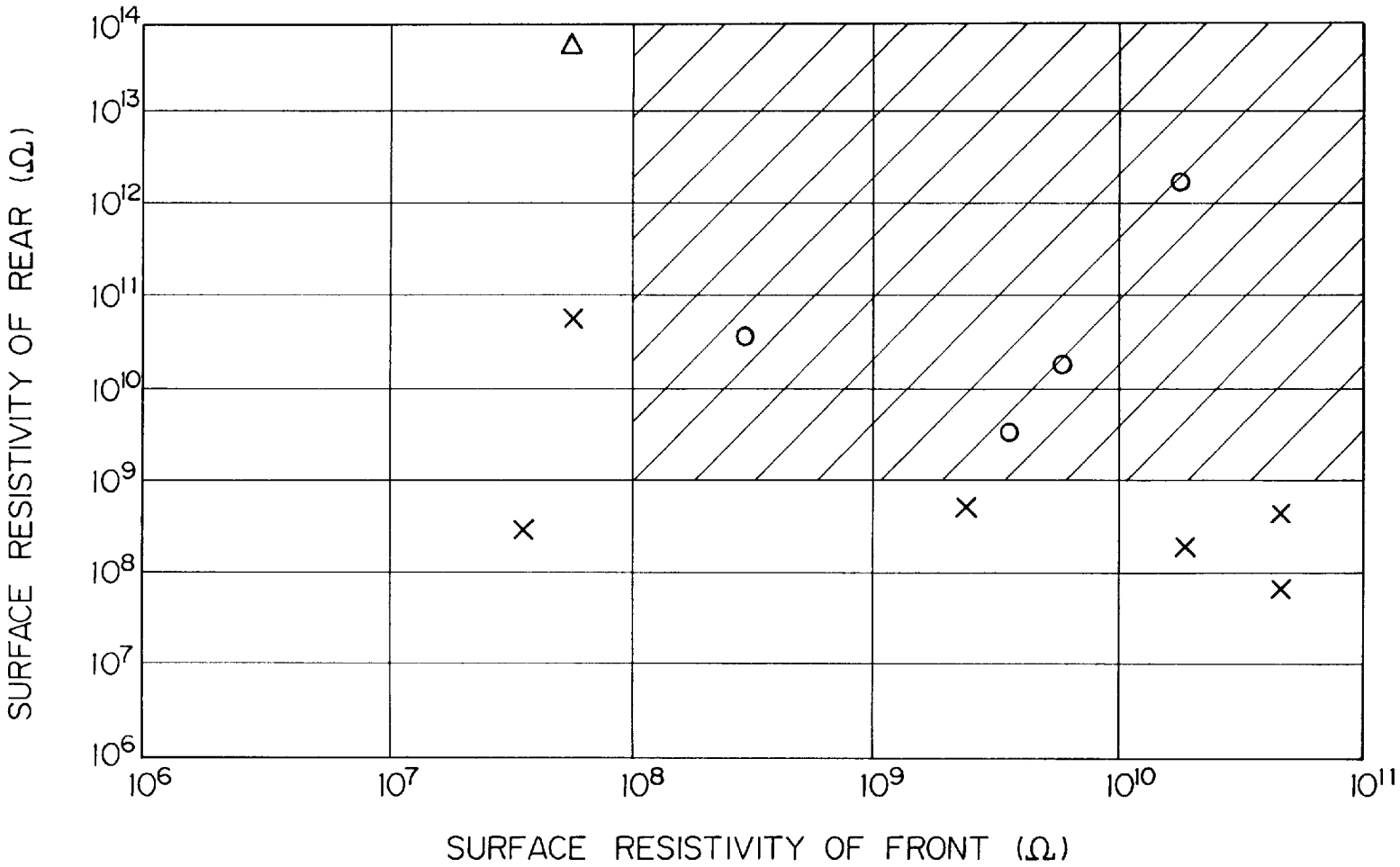
FIG. 6 is a graph plotting the results of experiments relating to the conveyance of a sheet.

As FIGS. 6 and 8 indicate, samples A, B, C and D implement desirable conveyance, or separation, while the other samples E–K are defective. In all of the samples A–D, the surface resistivity of the rear layer 2*b* and that of the front layer 2*a* were limited to the order of $10^{9}$ Ω or above and the order of $10^{8}$ Ω or above, respectively. As FIG. 6 also indicates, when the surface resistivity of the rear layer 2*b* is of the order of $10^{9}$ Ω or above, and when the surface resistivity of the front layer 2*a* is limited to the order of $10^{8}$ Ω, desirable conveyance is achievable. The desirable conveyance occurs in the area of FIG. 6 indicated by hatching.

Another series of experiments were conducted in accordance with JIS K6911 in order to determine a relation between the toner scattering and sheet separation and conveyance and the surface resistivities of the sheet S. Eleven samples different from each other in the surface resistivity of the front layer 2*a* and that of the rear layer 2*b* when applied with a DC 100 V were prepared. The toner scattering and the separation and conveyance of the sheet S were determined with each of the eleven samples. As for the toner scattering, the experiments were conducted in a low temperature, low humidity environment (temperature of 10° C. and humidity of 15%) more likely to bring about the toner scattering. As for the separation and conveyance, the experiments were conducted in a high temperature, high humidity environment (temperature of 30° C. and humidity of 90%). The results of such experiments are shown in FIGS. 6 and 9; circles and crosses indicate "good" and "no good", respectively.

As shown in FIGS. 6 and 9, samples A–D were desirable as to the separation and conveyance while the others were defective. The samples A–C and samples E, F and I–L were desirable as to the toner scattering while the other samples were defective. It was found that the separation and conveyance and toner scattering each was desirable in a particular range of surface resistivities. That is, the samples A–C were desirable both in separation and conveyance and in toner scattering while the other samples each was desirable in one of them, but defective in the other, or defective in both of them.

Studies on the above results showed that, paying attention to the samples desirable both in separation and conveyance and in toner scattering, the samples desirable in separation and conveyance were desirable in toner scattering also. By extended studies, there was found the fact of great interest that the surface resistivities measured in the high temperature, high humidity environment have influence on the separation and conveyance, i.e., the surface resistivities measured in such an environment effect both of the separation and conveyance and toner scattering. Specifically, there is a tendency that when the surface resistivity of the front layer of the belt measured in a high temperature, high humidity environment is equal to or lower than the surface resistivity of the rear layer, the result is desirable both in separation and conveyance and in toner scattering (samples A–C). Conversely, when the surface resistivity of the front layer measured in a high temperature, high humidity environment is higher than the surface resistivity of the rear layer, one or both of the separation and conveyance and toner scattering are degraded (samples E–H).

In the above experiments, the separation and conveyance were measured in a high temperature, high humidity environment while the toner scattering was measured in a low temperature, low humidity environment. Such conditions are severest for the individual factors. The samples desirable in separation and conveyance in the high temperature, high humidity environment are also desirable in a normal temperature, normal humidity atmosphere (offices in general usually held at a temperature of about 23° C. and a humidity of about 65%) and in a low temperature, low humidity environment, as determined by experiments. In addition, the samples desirable in toner scattering in the low temperature, low humidity environment are also desirable in the usual temperature, usual humidity environment and high temperature, high humidity environment, as also determined by experiments.

To achieve both of the desirable separation and conveyance and the prevention of toner scattering, there should be used a transfer belt having a front layer and a rear layer whose surface resistivities measured in a high temperature, high humidity environment satisfy a preselected relation, as stated above. In addition, it was found that both the separation and conveyance and toner scattering are more surely improved when the surface resistivities each lies in a particular range. The particular range is higher than $1\times10^{9}$ Ω inclusive, but lower than $1\times10^{14}$ Ω, for the rear layer 2*b* or higher than $1\times10^{8}$ Ω inclusive, but lower than $10^{14}$ Ω for the front layer 2*a,* as measured in a low temperature, low humidity environment through a high temperature, high humidity environment.

The volume resistivities of the samples were also measured in accordance with JIS K6911 by applying DC 100 V. The measurement showed that volume resistivities between the order of $10^{9}$ Ωcm and the order of $10^{14}$ Ωcm realized desirable separation and conveyance and desirable toner scattering in a low temperature, low humidity environment through a high temperature, high humidity environment.

Moreover, in FIG. 9, it is noteworthy that the relation between the surface resistivity of the front layer 2*a* and that of the rear layer 2*b* satisfying both of the separation and conveyance and toner scattering in the high temperature, high humidity environment is inverted in the low temperature, low humidity environment. Specifically, that the samples A–C satisfying both of the separation and conveyance and toner scattering each has surface resistivities related as "surface resistivity of front≦surface sensitivity of rear" in the high temperature, high humidity environment is the primary condition, as stated earlier. FIG. 9 additionally shows that all the samples A–C have their surface resistivities inverted in relation as "surface resistivity of front≧surface resistivity of rear" in the low temperature, low humidity environment. This indicates that a transfer belt having the relation of "surface resistivity of front≦surface resistivity of rear" in the high temperature, high humidity environment, but having the relation of "surface sensitivity of front≧surface sensitivity of rear" in the low temperature, low humidity environment further promotes the separation and conveyance and the obviation of toner scattering.

As to the separation and conveyance and the prevention of toner scatter, a transfer belt which having a relation of "surface resistance of front≦surface resistance of rear" in both of the high temperature, high humidity environment and low temperature, low humidity environment and satisfying the above optimal surface resistivity range was tested. This kind of belt was found to be acceptable, but not desirable.

In summary, it will be seen that the present invention provides an image forming apparatus and an image transferring device therefore which surely obviate toner scattering and improves the separation and conveyance of a recording medium to a noticeable degree.

Various modifications will become possible for those skilled in the art after receiving the teachings of the present disclosure without departing from the scope thereof. For example, while the illustrative embodiment has concentrated on an image carrier in the form of a photoconductive element, the image carrier may be implemented as an intermediate transfer body via which a toner image is transferred from the photoconductive element to a sheet. The conveying member for conveying a recording medium is not limited to a transfer belt, but may be implemented as a transfer drum for wrapping the recording medium therearound. The transfer belt having two layers as shown and described may be replaced with a transfer member having a laminate structure including three or more layers. The transfer belt may be formed of any suitable material other than the material shown and described so long as it satisfies the relation between the surface resistivities and the numerical ranges. The transfer roller playing the role of a transfer electrode for applying a transfer bias to the conveying member may be replaced with a brush, a blade or even a corona charger not contacting the conveying member. The transfer roller may contact the conveying member even at the nip for image transfer, as distinguished from the position downstream of the nip. Image transfer may be controlled by either one of constant current control and constant voltage control, as desired.

What is claimed is:

1. In a conveying member for conveying a recording medium carrying a toner image transferred from an image carrier, a rear of said conveying member remote from said image carrier has a surface resistivity higher than a surface resistivity of a front of said conveying member close to said image carrier.

2. A conveying member as claimed in claim 1, wherein the surface resistivities of said conveying member are measured in an environment of high temperature of 30° C. and high humidity of 90%.

3. A conveying member as claimed in claim 2, wherein the surface resistivity of the front is higher than $1\times10^{8}$ Ω inclusive, but lower than $1\times10^{14}$ Ω, while the surface resistivity of the rear is higher than $1\times10^{9}$ Ω inclusive, but lower than $10^{14}$ Ω.

4. A conveying member as claimed in claim 1, wherein the surface resistivity of the front is higher than $1\times10^{8}$ Ω inclusive, but lower than $1\times10^{14}$ Ω.

5. A conveying member as claimed in claim 1, wherein the surface resistivity of the rear is higher than $1\times10^{9}$ Ω inclusive, but lower than $1\times10^{14}$ Ω.

6. A conveying member as claimed in claim 1, wherein the surface resistivity of the front is higher than $1\times10^{8}$ Ω inclusive, but lower than $1\times10^{14}$ Ω while the surface resistivity of the rear is higher than $1\times10^{9}$ Ω inclusive, but lower than $1\times10^{14}$ Ω.

7. A conveying member as claimed in claim 6, wherein said conveying member comprises a belt.

8. A conveying member as claimed in claim 6, wherein said conveying member comprises a plurality of layers each being formed of a particular material.

9. A conveying member as claimed in claim 6, wherein said conveying member has a volume resistivity higher than an order of $10^{9}$ Ωcm inclusive, but lower than an order of $10^{14}$ Ωcm.

10. In a conveying member for conveying a recording medium carrying a toner image transferred from an image carrier, a rear of said conveying member remote from said image carrier has a surface resistivity equal to or higher than a surface resistivity of a front of said conveying member close to said image carrier when measured in an environment of high temperature of 30° C. and high humidity of 90%, but lower than the surface resistivity of the front when measured in an environment of low temperature of 10° C. and low humidity of 15%.

11. A conveying member as claimed in claim 10, wherein the surface resistivity of the front is higher than $1\times10^{8}$ Ω inclusive, but lower than $1\times10^{14}$ Ω.

12. A conveying member as claimed in claim 10, wherein the surface resistivity of the rear is higher than $1\times10^{9}$ Ω inclusive, but lower than $10^{14}$ Ω.

13. A conveying member as claimed in claim 10, wherein the surface resistivity of the front is higher than $1\times10^{8}$ Ω inclusive, but lower than $1\times10^{14}$ Ω, while the surface resistivity of the rear is higher than $1\times10^{9}$ Ω inclusive, but lower than $10^{14}$ Ω.

14. An image forming apparatus comprising:

an image carrier for forming a toner image thereon;

a conveying member for conveying a recording medium to which the toner image is transferred from said image carrier; and a transfer electrode for applying an image transfer bias to said conveying member;

said conveying member having a rear remote from said image carrier and having a surface resistivity higher than a surface resistivity of a front close to said image carrier.

15. A conveying member as claimed in claim 14, wherein the surface resistivities of said conveying member are measured in an environment of high temperature of 30° C. and high humidity of 90%.

16. A conveying member as claimed in claim 14, wherein the surface resistivity of the front is higher than $1\times10^{8}$ Ω inclusive, but lower than $1\times10^{14}$ Ω.

17. A conveying member as claimed in claim 14, wherein the surface resistivity of the rear is higher than $1\times10^{9}$ Ω inclusive, but lower than $10^{14}$ Ω.

18. A conveying member as claimed in claim 14, wherein the surface resistivity of the front is higher than $1\times10^{8}$ Ω inclusive, but lower than $1\times10^{14}$ Ω, while the surface resistivity of the rear is higher than $1\times10^{9}$ Ω inclusive, but lower than $10^{14}$ Ω.

19. A conveying member as claimed in claim 14, wherein said conveying member has a volume resistivity higher than an order of $10^{9}$ Ωcm inclusive, but lower than an order of $10^{14}$ Ωcm.

* * * * *